US006042480A

United States Patent [19]

Labelson

[11] Patent Number: 6,042,480

[45] Date of Patent: Mar. 28, 2000

[54] AMUSEMENT RAMP AND METHOD FOR CONSTRUCTING SAME

[76] Inventor: Ross Labelson, 900 Bronton Dr., Westbury, N.Y. 11590

[21] Appl. No.: 09/245,352

[22] Filed: Feb. 5, 1999

[51] Int. Cl.[7] ..... A63C 19/02

[52] U.S. Cl. ..... 472/89; 14/69.5

[58] Field of Search ..... 472/89, 90; 256/1, 256/59, 64; 14/69.5, 71.1; 52/182, 183; D21/817

[56] References Cited

U.S. PATENT DOCUMENTS

| | | | |
|---|---|---|---|
| D. 256,488 | 8/1980 | Firestone . | |
| D. 257,874 | 1/1981 | Sheehan et al. . | |
| D. 258,460 | 3/1981 | Firestone . | |
| 2,499,959 | 3/1950 | Kruse et al. . | |
| 2,724,495 | 11/1955 | Wasyluka . | |
| 3,271,222 | 9/1966 | Moorman . | |
| 3,406,617 | 10/1968 | Randazzo . | |
| 3,581,630 | 6/1971 | Del Piano . | |
| 3,771,891 | 11/1973 | Nirenski et al. . | |
| 3,790,019 | 2/1974 | Murray et al. . | |
| 3,976,526 | 8/1976 | Hovey et al. . | |
| 4,030,729 | 6/1977 | Nathaniel . | |
| 4,102,975 | 7/1978 | Doerer . | |
| 4,129,916 | 12/1978 | Schlesinger et al. . | |
| 4,285,514 | 8/1981 | Romero . | |
| 4,367,870 | 1/1983 | Birch . | |
| 5,100,358 | 3/1992 | Volgger . | |
| 5,203,948 | 4/1993 | Suska . | |
| 5,454,196 | 10/1995 | Gaines et al. | 52/183 |
| 5,524,310 | 6/1996 | Farnen . | |
| 5,599,235 | 2/1997 | Lynberg . | |
| 5,718,412 | 2/1998 | Levanas | 256/1 |

OTHER PUBLICATIONS

Precisionboard Ramp Instructions (date unknown).

*Primary Examiner*—Kien T. Nguyen
*Attorney, Agent, or Firm*—Pillsbury Madison & Sutro LLP

[57] ABSTRACT

The present invention provides a ramp having an underlying supporting structure and a ramp section having a unitary riding surface. The supporting structure includes a pair of side frames of similar shape. The two side frames are connected together by a plurality of crossbraces to form a supporting structure with an upper supporting surface generally having a desired shape of the finished ramp. It is generally flat and constructed to have enough flexibility to conform to the upper supporting surface of the supporting structure to provide the desired ramp shape while having enough stiffness to properly support the rider. The supporting frames are each provided with at least two locating tabs that project above the upper supporting surface of the supporting structure to engage corresponding notches in the ramp section. In this way, the ramp section can be initially installed on the supporting structure and will be held in place by the engagement of the tabs with the notches until the ramp section can be more securely fastened to the supporting structure. This self-locking mechanism allows one person to temporarily position and install the ramp section to the supporting structure so that the ramp section can then be secured to the supporting structure for use by the riders.

30 Claims, 2 Drawing Sheets

AMUSEMENT RAMP AND METHOD FOR CONSTRUCTING SAME

FIELD OF THE INVENTION

The present invention applies to amusement ramps and methods for constructing same, and, more particularly, to fingerboard and skateboard ramps.

DESCRIPTION OF THE PRIOR ART

Ramps for fingerboards and skateboards are known in the art. These ramps are used for performing stunts by the riders and are also for use with roller skates, in-line skates and BMX bikes. For example, Schlesinger, U.S. Pat. No. 4,129,916 discloses an Adjustable Skateboard Ramp, Romero, U.S. Pat. No. 4,285,514 discloses a Ramp Device for Practicing Wheeled Sports, Farnen, U.S. Pat. No. 5,524,310 discloses a Modular Halfpipe Skateboard Ramp and Method of Constructing and Sheehan, U.S. Pat. No. Des. 257,874 and Firestone, U.S. Pat. No. Des. 258,460 show designs for skateboard ramps. These references disclose a number of different designs of ramps and methods for constructing the ramps. Some of these references disclose the use of one-piece unitary riding surfaces, while other ramps known in the prior art disclose the use of multi-piece riding surfaces.

SUMMARY OF THE INVENTION

The present invention provides a ramp having an underlying supporting structure and a ramp section having a unitary riding surface. The supporting structure includes a pair of side frames of similar shape. The two side frames are connected together by a plurality of crossbraces to form a supporting structure with an upper supporting surface generally having a desired shape of the finished ramp. The ramp section can be constructed of a unitary piece of material or of a composite construction. It is generally flat and constructed to have enough flexibility to conform to the upper supporting surface of the supporting structure to provide the desired ramp shape while having enough stiffness to properly support the rider. The supporting frames are each provided with at least two locating tabs that project above the upper supporting surface of the supporting structure to engage corresponding notches in the ramp section. In this way, the ramp section can be initially installed on the supporting structure and will be held in place by the engagement of the tabs with the notches until the ramp section can be more securely fastened to the supporting structure. This self-locking mechanism allows one person to temporarily position and install the ramp section to the supporting structure so that the ramp section can then be secured to the supporting structure for use by the riders.

It is an object of the present invention to provide an amusement ramp having a supporting structure and a ramp section, whereby the ramp section can easily be installed to the supporting structure by one person.

It is a further object of the present invention to provide an amusement ramp having a supporting structure and a ramp section, whereby the ramp section can easily be temporarily installed to the supporting structure by one person to subsequently allow for more secure installation.

It is a further object of the present invention to provide a method for installing a surface section to a supporting structure whereby tabs on one of the surface section or the supporting structure engage notches or slots in the other of the surface section or supporting structure to position and hold the surface section with respect to the supporting structure.

The foregoing and other objects, features, characteristics and advantages of the present invention, as well as the methods of operation and functions of the related elements of structure, and the combination of parts and economies of manufacture, will be apparent from the following detailed description and the appended claims, taken in connection with the accompanying drawings, all of which form a part of the specification, wherein like reference numerals designate corresponding parts in the various figures.

DETAILED DESCRIPTION OF THE INVENTION

Figure 1:
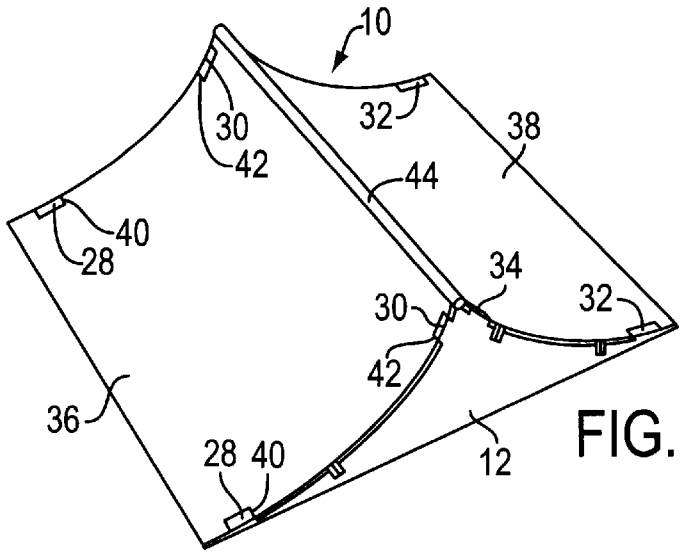
FIG. 1 is a perspective view of a ramp of the present invention.
Figure 2:
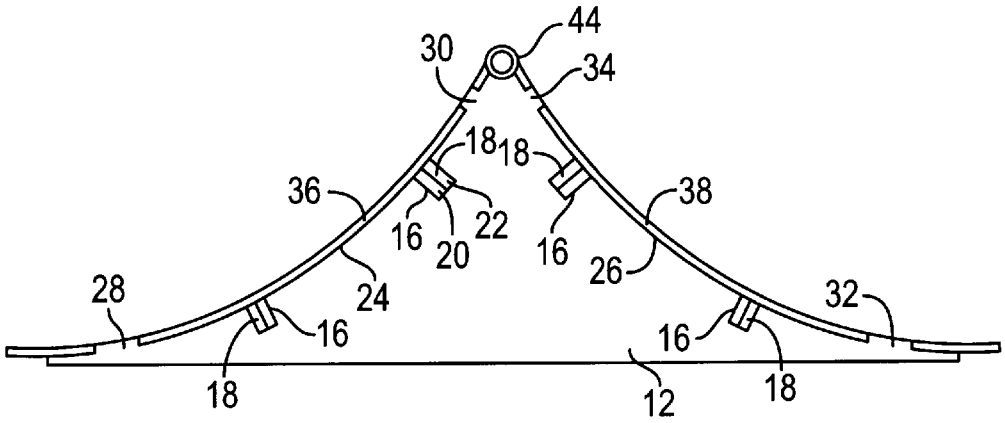
FIG. 2 is a side elevational view of the ramp of FIG. 1.
Figure 3:
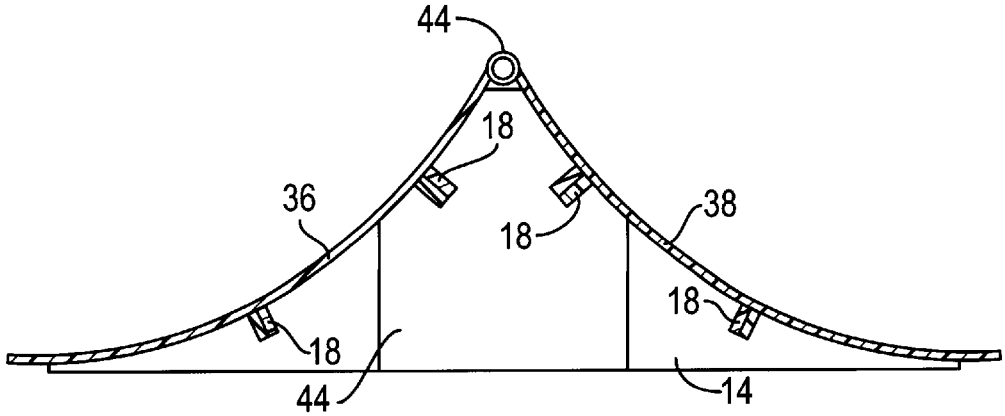
FIG. 3 is a sectional view of the ramp of FIG. 1.
Figure 4:
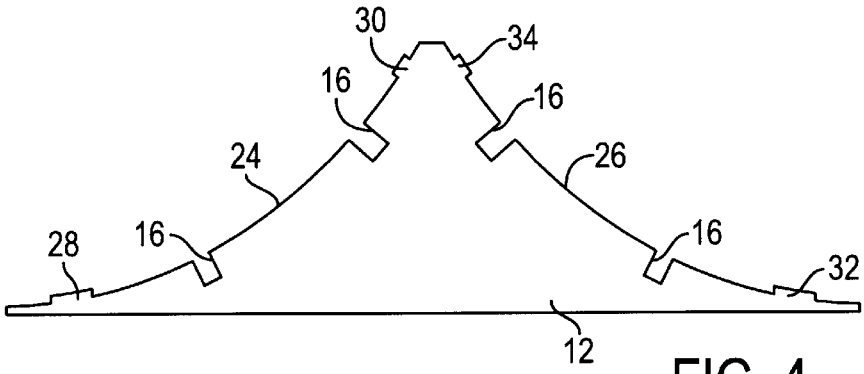
FIG. 4 is a side elevational view of a side frame of the ramp of FIG. 1.

FIG. 1 shows a perspective view of a ramp 10 of the present invention. The ramp includes a pair of side frames 12 and 14 (side frame 14 can be seen in FIG. 3). Each side frame has a plurality of notches 16 for supporting a like plurality of crossbraces 18. Each crossbrace 18 is positioned in a corresponding pair of notches 16 in the side frames 12 and 14 to attach the two side frames together and form a supporting structure. The crossbraces can be attached to the side frames by any known method, including glue, screws, nails, brackets, etc. Each crossbrace 18 can be constructed from a unitary piece of material or, as shown, can be constructed from two separate pieces of material 20 and 22 and attached together, again by any known method. Depending on the length of the supporting structure, it may be desirable to add one or more center frames to the structure to strengthen it. These frames can be shaped like the side frames (with or without the locating tabs discussed below) or can be truncated. The center frame or frames can be shaped as shown in FIG. 3, wherein center frame 44 has truncated sides as compared to the side frames, and does not include any locating tabs.

Figure 5:
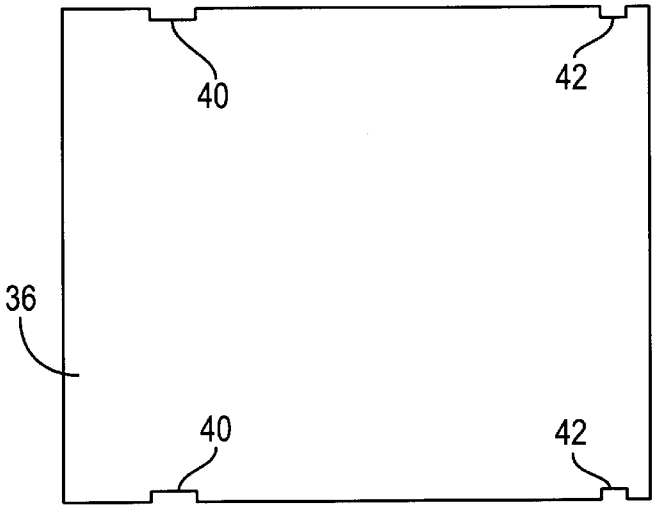
FIG. 5 is a top elevational view of a ramp section of the ramp of FIG. 1.

Each side frame also has two supporting surfaces 24 and 26. Supporting surface has two extending locating tabs 28 and 30 and supporting surface 26 has two extending locating tabs 32 and 34. Supporting surface 24 supports a ramp section 36 and supporting surface 26 supports a ramp section 38. As can be seen in FIG. 5, ramp section 36 is of a generally rectangular shape and has two locking notches or slots 40 and two locking notches or slots 42. The locking notches 40 are adapted to engage the locating tabs 28 on side frames 12 and 14 and the two locking notches 42 are adapted to engage the locating tabs 30 on side frames 12 and 14. The locating tabs 28 (and correspondingly, the locking notches 40) can be the same width as the locating tabs 30 (and correspondingly, the locking notches 42) with both tabs and notches symmetrically located so that the ramp section has no specific required orientation with respect to the supporting structure. Alternatively, the notches and tabs can be of different widths and/or spacing so as to require a specific orientation of the ramp section to the supporting structure upon installation. Since in this embodiment the two ramp sections 36 and 38 are similar to each other, the description above with respect to ramp section 36 would also correspondingly apply to ramp surface 38.

While the supporting surfaces 24 and 26 are curved, the ramp sections 36 and 38 are generally flat in their relaxed state. In such situations, it is often difficult to position the ramp sections and get them to conform to the curved supporting surfaces without additional hands, holding weights and/or clamping mechanisms. However, the provision of the locking notches and locating tabs minimizes or eliminates such need.

The distance between notches 40 and 42 is set to be the same distance between the tabs 28 and 30 along the curve of the supporting surface 24 (the arc length). This distance is longer than the straight-line distance between the tabs 28 and 30 (the chord length). By positioning ramp section 36 so that the notches 40 engage the locating tabs 28, the ramp section can then be carefully pressed in toward the supporting surface 24 while being held in place by the locating tabs 28. As the ramp section 36 is pressed into to place to conform to the supporting surface 24, starting from the notches 40 and working toward the notches 42, the notches 42 will come into alignment with the tabs 30 so that the this end of the ramp section can be pressed against the supporting surface to engage notches 42 with tabs 30. The force of the ramp section 36 trying to return to its relaxed, flat state causes a spring lock between the notches 40 and 42 and tabs 28 and 30, respectively, thereby temporarily holding the ramp section in place until more secure or permanent fasteners can be utilized or take effect (such as glue). Depending on the specific design of the ramp and materials, the spring lock may be sufficient to hold the ramp section to the supporting structure without additioning fasteners. The tab/notch engagement is also believed to improve the overall strength of the secure attachment between the ramp sections and the support structure by helping to maintain a secure positioning between the two.

This effect can usually be accomplished by the use of two tab/notch pairs at the outer ends of the curve as shown with the above embodiment, but if desired, additional tab/notch pairs can also be utilized. Further, even if the supporting surface is not curved, but flat, the tab/notch pairs can be used to accurately position and hold the ramp section to the supporting surface, although no spring locking will be in effect under such circumstances. Alternatively, the ramp section can be provided with tabs for engaging notches in the supporting structure or can utilize a combination of tabs and notches for engaging a corresponding combination of notches or tabs on the supporting structure. Although the tabs and notches are shown to be rectangular, they can be of any desired shape, including round, triangular, etc. The tabs and notches need not be provided at the edge of the ramp section/supporting structure but can be provided elsewhere on the ramp section/supporting structure. The notches are shown herein to be open on one side but they can also be closed on all sides and need not completely pierce the ramp section/supporting structure but may be in the form of blind holes. Alternatively, the ramp section and supporting structure can be provided with pre-existing bores that will align when the ramp section is pressed down to conform to the support surface such that pins, bolts, or screws, etc. can be inserted through the aligned bores to retain the ramp section to the supporting structure.

The ramp 10 also includes an edge coping at the intersection of the ramp sections 36 and 38 to provide a uniform, durable contact surface. The edge coping 44 in the preferred fingerboard embodiment is constructed of round metal tubing and glued to the ramp, but other materials, shapes and methods of attachment can also be utilized.

The ramp of the present invention can be constructed of various types of materials. For, instance, the ramps can be constructed of wood, plastic, cardboard or metal and different materials can be used for different components. In the presently preferred embodiment of the present invention used as a fingerboard ramp, the ramp is constructed from die-cut pieces of relatively thin, soft wood sheets. The sheets can be of the same thickness or have different thicknesses for different components. It may also be desirable to construct the ramp section from a harder wood or other material to provide increased durability. Also the ramp section can be of a uniform material or can be of a composite construction of multiple layers, pieces or materials. While a bottom surface of the ramp section can be segmented, it is preferred, though not required, to maintain the top riding surface of the ramp section as a single unitary piece to provide an enhance riding surface. This provides an improved riding surface as compared to multi-piece riding surfaces of prior art devices.

In the preferred fingerboard embodiment, the components are presently held together with glue. Further, the glue for attaching the ramp section to the supporting surface is preferably applied to the contacting surfaces prior to assembly but can also be applied after assembly and locking of the ramp section to the supporting surface. In a larger embodiment, additional fastening mechanisms will likely be desired, including screws, bolts, nails, clamps, soldering, welding, etc. In the preferred fingerboard embodiment, a kit is provided with all of the necessary cut pieces for assembly by the user. The present invention makes it easier for the user to assemble the pieces into a finished ramp, especially when the user may be a teenager or younger child who has not developed the desired dexterity or may have limited additional tools to assist with the assembly. With smaller ramps such as fingerboard ramps, the assembly can be accomplished by a single person. Of course, larger ramps for skateboards, in-line skates, bikes, etc., may require additional individuals for assembly.

Figure 6:
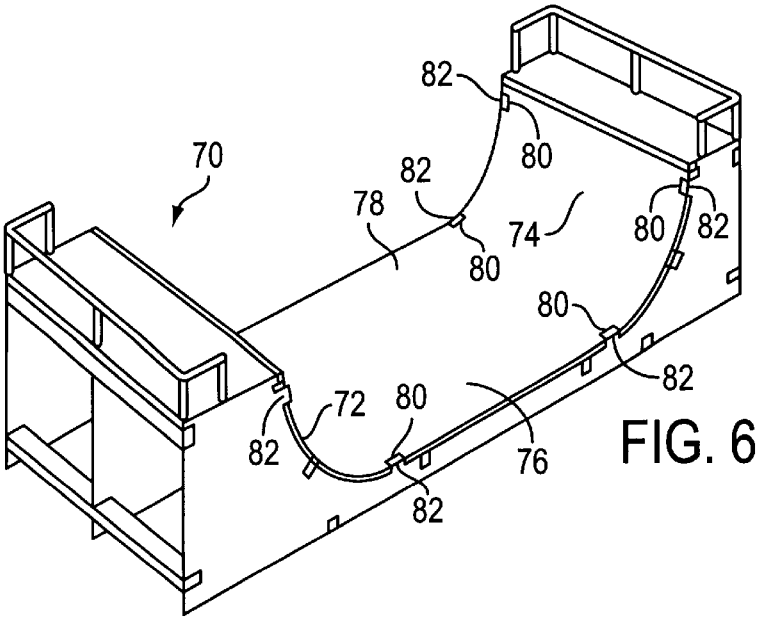
FIG. 6 is a perspective view of an alternative embodiment of a ramp of the present invention.

An alternative embodiment of the present invention is shown in perspective in FIG. 6. This ramp 70 includes two curved sections 72 and 74 facing each other and joined together by a flat intermediate section 76. Other than the shape of ramp 70, its construction is similar to the construction of ramp 10. A ramp section 78 is provided which includes a plurality of notches 80 which engage a like plurality of tabs for holding the ramp section 78 in place upon installation. In this embodiment, because of the relative length of the ramp section, it has been found to be desirable to align and engage the four middle notches 80 bordering the intermediate section 76 with the corresponding tabs 82 first and then holding this portion in place with a weight (such as a book) prior to engaging the outermost notches and tabs. This prevents the middle notches from disengaging from the middle tabs as the remaining notches are engaged with the remaining tabs. In another alternative embodiment, a halfpipe-shaped ramp can be constructed similarly to the ramp 70 by not providing the flat intermediate section 76 between the two curved sections 72 and 74. Alternative ramp shapes can also be utilized, including ramps where the side frames are not parallel to each other but can be at an angle to each other to form with the ramp section, for instance a truncated partial cone-shaped ramp. The present invention can also be applied to other types of structures where a surface sheet is being attached to a supporting structure.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. An amusement ramp, comprising:

a pair of side frames, each side frame having at least one supporting surface for supporting a ramp section, at least one of the side frames having at least two locating tabs;

at least one crossbrace connecting the two side frames in a fixed relationship;

a semi-flexible ramp section constructed and arranged to engage the supporting surfaces, the ramp section having a plurality of notches arranged to engage the side frame tabs when the ramp section is installed onto the side frames to hold the ramp section in a desired position.

2. An amusement ramp as in claim 1, wherein the supporting surface of each of the pair of side frames includes a curved portion for supporting the ramp section in a curved state.

3. An amusement ramp as in claim 2, wherein the at least two tabs of each side frame are positioned on the supporting surface of the side frame.

4. An amusement ramp as in claim 3, wherein a portion of the curved portion of the supporting surface is positioned between the two tabs.

5. An amusement ramp as in claim 4, wherein the two tabs project above the supporting surface.

6. An amusement ramp as in claim 4, wherein a length between two of the notches of the ramp section arranged to engage two of the tabs of one of the side frames is greater than a chord length between the two tabs and generally similar to an arc length between the two tabs along the curved portion of the supporting surface.

7. An amusement ramp as in claim 6, wherein when the ramp section is conformed to the supporting surfaces of the side frames and the notches of the ramp section are engaged with the tabs of the side frame, the difference between the length between the notches and the chord length between the corresponding tabs creates a spring lock resulting from a force by the ramp section to straighten itself, thereby holding the ramp section to the side frame.

8. An amusement ramp as in claim 7, and further comprising at least one of a metal rail and a metal coping attached to the amusement ramp to provide an additional riding surface.

9. An amusement ramp as in claim 1, and further comprising:

a center frame having at least one supporting surface for supporting the ramp section.

10. An amusement ramp as in claim 9, wherein the center frame is connected to at least one of the side frames in a fixed relationship by the crossbrace.

11. An amusement ramp as in claim 10, wherein the center frame includes at least two locating tabs and the ramp section includes at least two center notches arranged to engage the center frame tabs when the ramp section is installed onto the frames.

12. An amusement ramp as in claim 11, wherein a length between two of the notches of the ramp section arranged to engage two of the tabs of one of the side frames is greater than a chord length between the two tabs and generally similar to an arc length between the two tabs along the curved portion of the supporting surface.

13. An amusement ramp as in claim 12, wherein when the ramp section is conformed to the supporting surfaces of the side frames and the notches of the ramp section are engaged with the tabs of the side frame, the difference between the length between the notches and the chord length between the corresponding tabs creates a spring lock resulting from a force by the ramp section to straighten itself, thereby holding the ramp section to the side frame.

14. An amusement ramp, comprising:

a base having a plurality of notches/tabs and a supporting surface for supporting a ramp section, a semi-flexible ramp section constructed and arranged to engage the supporting surface, the ramp section having a plurality of notches/tabs arranged to engage the base notches/tabs when the ramp section is installed onto the base to hold the ramp section in a desired position.

15. An amusement ramp as in claim 14, wherein the supporting surface of the base includes a curved portion for supporting the ramp section in a curved state.

16. An amusement ramp as in claim 15, wherein the at least two notches/tabs of the base are positioned on the supporting surface of the base.

17. An amusement ramp as in claim 16, wherein a portion of the curved portion of the supporting surface is positioned between the two notches/tabs.

18. An amusement ramp as in claim 17, wherein a length between two of the notches/tabs of the ramp section arranged to engage two of the notches/tabs of the base is greater than a chord length between the two base notches/tabs and generally similar to an arc length between the two base notches/tabs along the curved portion of the supporting surface.

19. An amusement ramp as in claim 7, wherein when the ramp section is conformed to the supporting surfaces of the base and the notches/tabs of the ramp section are engaged with the notches/tabs of the base, the difference between the length between the ramp section notches/tabs and the chord length between the corresponding base notches/tabs creates a spring lock resulting from a force by the ramp section to straighten itself, thereby holding the ramp section to the base.

20. An amusement ramp as in claim 15, wherein a length between two of the notches/tabs of the ramp section arranged to engage two of the notches/tabs of the base is greater than a chord length between the two base notches/tabs and generally similar to an arc length between the two base notches/tabs along the curved portion of the supporting surface.

21. An amusement ramp as in claim 20, wherein when the ramp section is conformed to the supporting surfaces of the base and the notches/tabs of the ramp section are engaged with the notches/tabs of the base, the difference between the length between the ramp section notches/tabs and the chord length between the corresponding base notches/tabs creates a spring lock resulting from a force by the ramp section to straighten itself, thereby holding the ramp section to the base.

22. An amusement ramp as in claim 14, and further comprising at least one of a metal rail and a metal coping attached to the amusement ramp to provide an additional riding surface.

23. A fingerboard amusement ramp as in claim 22, wherein the at least one of a metal rail and a metal coping is attached to the base with an adhesive.

24. A fingerboard amusement ramp as in claim 23, wherein the base is constructed of plastic.

25. A fingerboard amusement ramp as in claim 23, wherein the base has at least one concave curved riding surface and at least one flat riding surface.

26. An amusement ramp, comprising:

a pair of side frames, each side frame having a supporting surface for supporting a ramp section and two locating tabs projecting above the supporting surface;

a crossbrace connecting the two side frames in a fixed relationship;

a semi-flexible ramp section constructed and arranged to engage the supporting surfaces, the ramp section having a plurality of notches arranged to engage the side frame tabs when the ramp section is installed onto the side frames to hold the ramp section in a desired position, wherein the supporting surface of each of the pair of side frames includes a curved portion between the two locating tabs for supporting the ramp section in a curved state, a length between two of the notches of the ramp section arranged to engage two of the tabs of one of the side frames is greater than a chord length between the two tabs and generally similar to an arc length between the two tabs along the curved portion of the supporting surface, such that when the ramp section is conformed to the supporting surfaces of the side frames and the notches of the ramp section are engaged with the tabs of the side frames, the difference between the length between the notches and the chord length between the corresponding tabs creates a spring lock resulting from a force by the ramp section to straighten itself, thereby holding the ramp section to the side frames.

27. An amusement ramp as in claim 26, and further comprising:

a center frame having a supporting surface for supporting the ramp section.

28. An amusement ramp as in claim 27, wherein the center frame is connected to the side frames in a fixed relationship by the crossbrace.

29. An amusement ramp as in claim 28, wherein the center frame includes at least two locating tabs and the ramp section includes at least two center notches arranged to engage the center frame tabs when the ramp section is installed onto the frames.

30. An amusement ramp as in claim 29, and further comprising a metal coping attached to the amusement ramp to provide an additional riding surface.

* * * * *